US008960104B2

(12) United States Patent
Copeland et al.

(10) Patent No.: US 8,960,104 B2
(45) Date of Patent: Feb. 24, 2015

(54) TABLE

(71) Applicant: Steelcase Inc., Grand Rapids, MI (US)

(72) Inventors: Stephan Copeland, Merion Station, PA (US); Michael Jurgen Strasser, San Francisco, CA (US); Thomas Edward King, Redwood City, CA (US)

(73) Assignee: Steelcase Inc., Grand Rapids, MI (US)

( * ) Notice: Subject to any disclaimer, the term of this patent is extended or adjusted under 35 U.S.C. 154(b) by 26 days.

(21) Appl. No.: 13/755,658

(22) Filed: Jan. 31, 2013

(65) Prior Publication Data

US 2013/0284077 A1 Oct. 31, 2013

Related U.S. Application Data

(63) Continuation-in-part of application No. 29/419,463, filed on Apr. 27, 2012, now Pat. No. Des. 694,044.

(51) Int. Cl.

| | |
|---|---|
| ***A47B 3/02*** | (2006.01) |
| ***A47B 3/00*** | (2006.01) |
| ***A47B 9/00*** | (2006.01) |
| ***A47B 9/06*** | (2006.01) |
| ***A47B 3/08*** | (2006.01) |

(52) U.S. Cl.

CPC ... *A47B 3/00* (2013.01); *A47B 9/00* (2013.01); *A47B 9/06* (2013.01); *A47B 3/08* (2013.01); *A47B 3/0815* (2013.01)

USPC ..... 108/117; 108/5; 108/6; 108/146

(58) Field of Classification Search

CPC ..... A47B 21/0314; A47B 3/00; A47B 3/002; A47B 3/0815; A47B 2003/00; A47B 2003/002; A47B 2009/06

USPC ..... 108/6–10, 144.11, 145–147, 147.19, 108/147.2, 147.21, 147.22, 115–116, 124

See application file for complete search history.

(56) References Cited

U.S. PATENT DOCUMENTS

| | | | | |
|---|---|---|---|---|
| 1,053,357 | A | 2/1913 | Carter | |
| 1,394,526 | A | 10/1921 | Amsden | |
| 1,544,935 | A | 7/1925 | Preston | |
| 1,797,847 | A | 3/1931 | Vandagriff | |
| 1,807,500 | A * | 5/1931 | West | 108/8 |
| 2,150,397 | A | 3/1939 | Owen | |
| D122,925 | S | 10/1940 | Holden et al. | |
| 2,299,909 | A | 10/1942 | Linderme | |
| 2,604,884 | A * | 7/1952 | Brooks | 126/30 |
| 2,685,487 | A | 8/1954 | Woller | |

(Continued)

FOREIGN PATENT DOCUMENTS

| | | | |
|---|---|---|---|
| EP | 995376 | A1 | 4/2000 |
| GB | 746455 | A | 3/1956 |

*Primary Examiner* — Hanh V Tran

(57) ABSTRACT

The disclosed article of furniture comprises a table with an adjustable base, a support, and a worksurface. The table can be deployed in a generally upright position for use and can be folded into a compact form for storage. The worksurface is mounted on an arm coupled to the base and is rotatable relative to the arm. The arm may be folded into the support. The support may be folded into the base. The worksurface may fit within a cavity between the legs of the base when the table is in the stowed position. The worksurface may have a height adjustment mechanism for the worksurface. The height adjustment mechanism may be configured to adjust to a predetermined "home" position when the support is folded into the base for the stowing position.

31 Claims, 18 Drawing Sheets

(56) References Cited

U.S. PATENT DOCUMENTS 2,686,094 A 8/1954 Terry
3,217,672 A 11/1965 Haughey
3,358,620 A 12/1967 Paolo
3,438,606 A 4/1969 Rubin
3,669,392 A 6/1972 Saunders
3,682,108 A * 8/1972 Perminov ..... 108/6
3,682,112 A 8/1972 Emrick
3,853,297 A 12/1974 Drolet
3,854,428 A 12/1974 Fullenkamp
D236,045 S 7/1975 Petrie
D236,775 S 9/1975 Cowley
3,903,812 A 9/1975 Cowley
3,908,561 A 9/1975 Cowley
D246,880 S 1/1978 Miola
4,248,161 A 2/1981 Adair et al.
4,350,098 A 9/1982 Shirono et al.
4,434,722 A * 3/1984 Solomon et al. ..... 108/8
4,496,190 A 1/1985 Barley
D289,588 S 5/1987 Winzeler, II
D296,851 S 7/1988 Kelley
4,807,836 A 2/1989 Price et al.
4,838,181 A 6/1989 Luyk
4,879,954 A 11/1989 Sawamura et al.
4,938,153 A * 7/1990 Maes ..... 108/128
4,949,650 A 8/1990 Allard
4,955,294 A 9/1990 Abe
D314,878 S 2/1991 Hart
RE33,645 E 7/1991 Coote
5,090,768 A 2/1992 Re et al.
5,144,898 A 9/1992 Posly
D341,507 S 11/1993 Harvey et al.
5,265,938 A 11/1993 Melhuish et al.
5,359,741 A 11/1994 Lang
D353,287 S 12/1994 Hemberger
5,382,079 A 1/1995 Wilson et al.
5,439,267 A 8/1995 Peterson et al.
5,460,392 A 10/1995 Hansen
5,465,671 A 11/1995 Genest
5,483,903 A 1/1996 Pierce et al.
5,549,052 A 8/1996 Hoffman
5,606,917 A 3/1997 Cauffiel
5,615,620 A 4/1997 Owen
5,622,119 A 4/1997 Hsieh
5,664,842 A 9/1997 Tseng
5,669,107 A 9/1997 Carlsen et al.
5,673,633 A 10/1997 Pfister
5,845,589 A 12/1998 Pfister
5,894,805 A 4/1999 Raasch et al.
5,909,864 A 6/1999 Wang
5,934,490 A * 8/1999 Mora ..... 212/176
5,940,912 A 8/1999 Keselman et al.
D417,980 S 12/1999 Fraquelli et al.
6,073,997 A 6/2000 Koh
6,076,787 A 6/2000 Troyer
6,142,559 A 11/2000 Sorel et al.
6,168,237 B1 1/2001 Lamart et al.
D441,224 S 5/2001 Scheper et al.
6,296,312 B1 10/2001 Congleton et al.
6,327,982 B1 * 12/2001 Jackson ..... 108/5
6,394,005 B1 5/2002 Isensee et al.
6,578,500 B2 6/2003 Malizia
6,688,634 B2 2/2004 Noffsinger
6,694,891 B1 * 2/2004 Lai ..... 108/6
6,817,303 B2 11/2004 Gosselin
6,832,560 B2 12/2004 Seiler et al.
6,845,723 B2 1/2005 Kottman et al.
6,857,378 B2 2/2005 Goodman et al.
D515,850 S 2/2006 Duke
D531,839 S 11/2006 Lade
D548,496 S 8/2007 Samtani
7,341,006 B2 3/2008 Hernandez
7,350,469 B2 4/2008 Koning et al.
7,370,910 B2 5/2008 Piretti
7,469,645 B2 12/2008 Mangano et al.
7,520,228 B2 4/2009 Mangano et al.
D595,070 S 6/2009 Wacker
7,546,810 B2 6/2009 Hernandez
7,597,302 B2 * 10/2009 Lee et al. ..... 248/371
7,631,604 B2 12/2009 Huang
D611,737 S 3/2010 Miller et al.
D612,169 S 3/2010 Chang
D614,892 S 5/2010 Miller et al.
D615,324 S 5/2010 Yamamoto
D620,276 S 7/2010 Miller
7,770,979 B2 8/2010 He
7,823,518 B2 11/2010 Phillips
7,828,389 B2 11/2010 Oda
7,836,833 B2 11/2010 Kumazawa
7,856,743 B2 12/2010 Ma et al.
D640,486 S 6/2011 Saelid
8,051,784 B2 11/2011 Hsu
D655,111 S 3/2012 Kincaid et al.
8,136,773 B2 * 3/2012 Schmutzer et al. ..... 248/125.8
8,161,890 B2 * 4/2012 Wang ..... 108/6
8,191,487 B2 * 6/2012 Theesfeld et al. ..... 108/144.11
2004/0079845 A1 4/2004 Wilcox
2005/0183641 A1 8/2005 Suzuki
2005/0235886 A1 10/2005 Koning et al.
2007/0089648 A1 * 4/2007 Harrison et al. ..... 108/115
2007/0234934 A1 * 10/2007 Branch et al. ..... 108/115
2007/0256611 A1 * 11/2007 Huang ..... 108/116
2007/0289506 A1 * 12/2007 Branch et al. ..... 108/116
2009/0241805 A1 * 10/2009 Hernandez ..... 108/6
2009/0272860 A1 11/2009 Reinke
2009/0283020 A1 11/2009 Hsu
2010/0095565 A1 4/2010 Ma et al.
2010/0300242 A1 12/2010 Rutz
2010/0307383 A1 12/2010 Hoffman
2011/0084535 A1 4/2011 Diffrient
2011/0147547 A1 6/2011 Fitzpatrick et al.

* cited by examiner

TABLE

CROSS-REFERENCE TO RELATED APPLICATION

This application is a continuation-in-part of U.S. design patent application Ser. No. 29/419,463, filed on Apr. 27, 2012, which application is hereby incorporated by reference in its entirety.

FIELD

The present invention relates to a table and particularly to a table that can be deployed into a generally upright form for use and stowed into a substantially compact form for storage.

BACKGROUND

It is known to provide for a table having a base and worksurface. In a typical configuration the base provides legs that rest on the floor and the worksurface provides a horizontal platform for work activities such as use of a portable computer or writing/drawing. It is also known to provide a table with legs that can be folded down when the table is in use and up (toward the worksurface) when the table is not in use and is to be stored. Such tables may typically be sized and configured to have a worksurface suitable for use by multiple persons. Such tables could be used in a residential or commercial work environment.

It is also known to provide for an article of furniture providing a worksurface configured for use by an individual person. For example, it is known to provide for a chair having a worksurface; such a worksurface may be adjustable for the individual, for example, a worksurface that can be rotated and/or lifted by the individual.

It is further known to provide for an article of furniture that is transportable, such as table or chair that can be carried or rolled from one location to another in the work environment. Such articles of furniture are typically characterized by a lightweight (or lighter in weight) construction. However such articles of furniture may not typically provide both a lightweight construction suitable for convenient transportability and a sturdy/stable construction suitable for convenient use in a work environment.

SUMMARY

It would be advantageous to provide for a table that provides for positional adjustment of the worksurface in use when deployed. It would also be advantageous to provide for a table that can be folded into a compact form for carrying and stowage. It would further be advantageous to provide for a transportable table that provides for positional adjustment of the worksurface in use and that can be folded into a compact form for storage.

The present invention relates to an article of furniture configured to be deployed in a generally upright use position and to be folded into a generally compact stowed position. The article includes a base, a support coupled to the base, an arm coupled to the support, and a worksurface coupled to the arm. The article includes a first pivot mechanism coupling the support to the base so that the support can be pivoted relative to the base and folded from a generally vertical orientation in the use position to a generally horizontal orientation for the stowed position. The article includes a second pivot mechanism coupling the arm to the support so that the arm can be rotated relative to the support and folded from a generally horizontal orientation in the use position to a generally vertical orientation for the stowed position. The article includes a third pivot mechanism coupling the worksurface to the arm so that the worksurface can be rotated relative to the base when in the use position.

The present invention also relates to an article of furniture configured to be deployed to a use position and to be folded into a stowed position. The article includes a base, a support coupled to the base, an arm coupled to the support and a worksurface coupled to the arm. The article also includes a first pivot mechanism coupling support to base so that support can be pivoted relative to the base and folded from generally vertical orientation in the use position to a generally horizontal orientation for the stowed position and a second pivot mechanism coupling the worksurface to the arm so that the worksurface can be rotated in a plane relative to the base. The support includes a height adjustment mechanism so that the worksurface can be presented at (a) a first height relative to the base and (b) a second height relative to the base and (c) a plurality of heights in between the first height and the second height. The height adjustment mechanism is in a first position to provide the first height and engaged in a second position to provide the second height. The height adjustment mechanism is engaged in a home position between the first position and the second position when the arm is folded to the stowed position.

The present invention further relates to a transportable table configured to be deployed to a use position and to be folded into a stowed position. The table includes a base, a support coupled to the base, an arm coupled to the support, and a worksurface coupled to the arm. The support has a height adjustment mechanism the support having a height adjustment mechanism so that the worksurface can be retained at (a) a fully-lowered first height relative to the base and (b) a fully-raised second height relative to the base and (c) a plurality of heights in between the first height and the second height. The height adjustment mechanism includes a rack having a series of teeth forming a series of notches and a bar having a projection configured so that the bar and the rack are (a) in a first position with the projection of the bar adjacent to a first tooth of the rack when at the first height and (b) engaged in a second position with the projection of the bar in a notch of the rack when at the second height and (c) able to be engaged in a home position between the first position and the second position with the projection of the bar in a first notch of the rack when the support has been folded to the stowed position.

FIGURES

DESCRIPTION

Figure 1:
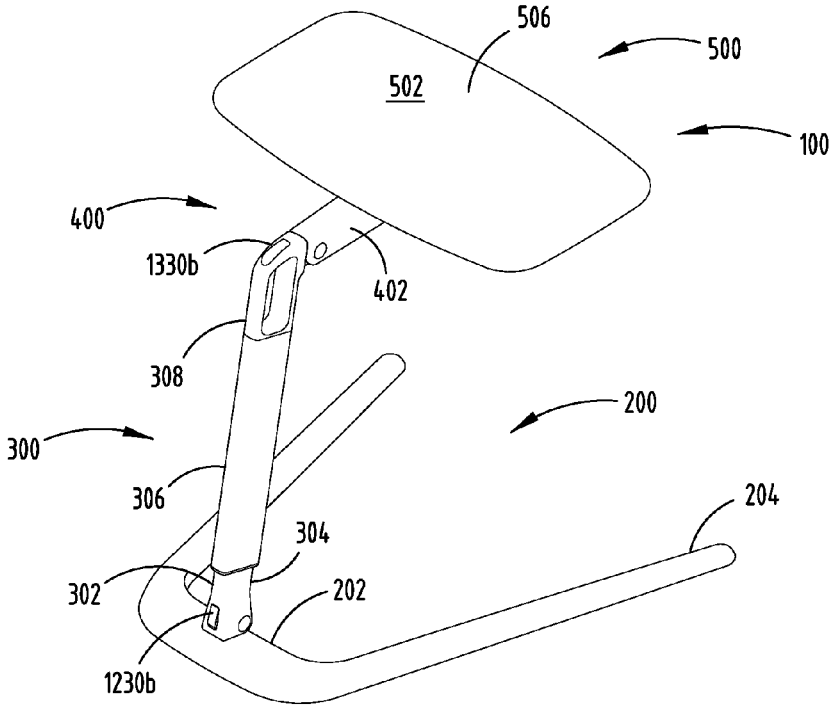
FIG. 1 is a rear perspective view of a table according to an exemplary embodiment.

Referring to FIGS. 1 through 9 and 23 through 28, an article of furniture is shown as a transportable table 100. Table 100 includes a base assembly 200, a support assembly 300, an arm assembly 400 and a worksurface assembly 500. According to an exemplary embodiment, table 100 is configured to provide a worksurface 502 in a deployed position for use (see, e.g., FIGS. 1-9) and to be folded into a compact stowed position for storage (see, e.g., FIGS. 23-28). According to any preferred embodiment, the table is configured for use in a residential and/or commercial work environment (such as an office) but can be used in any of a wide variety of other environments, including but not limited to a home/residential space, professional office, hospitality/reception area, hospital/medical care facility, school or educational facility, etc.

As shown in FIGS. 1-9, base or base assembly 200 of table 100 is configured to rest in a generally horizontal orientation on a generally horizontal floor. Base 200 has a generally U-shaped/V-shaped configuration with a center portion 202 and two legs 204 which extend from center portion 202 to create a center open area or cavity 206. A set of elastomeric pads 208 (e.g. glides or levelers) is provided for attachment on the bottom of the center portion 202 and legs 204 of base 200. According to a preferred embodiment, the legs of the base are provided with an internal rigidifying structure (e.g. circumferential and/or longitudinal ribs or webs) to prevent deflection or bending. According to any preferred embodiment, the legs and center portion of the base are configured to provide a stable base structure to support loads and resist tipping with objects placed on the worksurface (e.g. books, papers, computing devices, etc.) as the worksurface is positioned within a range of motion provided by the dimensions and mechanisms.

As shown in FIGS. 1-9, support or support assembly 300 of table 100 is configured to be mounted to a post 302 extending from center portion 202 of base 200. In the deployed or use position, support 300 is in a generally vertical orientation (e.g. slightly angled as shown or generally perpendicular to the base) relative to base 200. Support 300 includes an inner tube member 304 installed on post 302 and an outer tube member 306 (with a handle 308) installed over inner tube member 304. Handle 308 provides a convenient manner for the table to be transported by carrying to and from work environments or to and from storage locations; handle provides a projecting structure (with a cavity) that may also be used to stack or "rack" the table when stowed (e.g. to be stored such as on a hook or a rack (not shown)). According to another exemplary embodiment, when the table is stowed in association with another article of furniture (e.g. under a sofa or behind a cabinet) or in a storage area (e.g. upright in closet or flat on or under a shelf), the handle will facilitate convenient accessibility and positioning of the table.

As shown in FIGS. 1-9, arm or arm assembly 400 of table 100 is configured to be mounted to support 300; when in the deployed or use position arm 400 is in a generally horizontal orientation (e.g. generally perpendicular to support 300 and parallel to base 200). Arm assembly 400 includes an upper portion 402 with a mounting plate 408 and a support shown as lower portion 404.

As shown in FIGS. 1-9, worksurface or worksurface assembly 500 of table 100 is coupled to arm 400 by mounting plate 408. Worksurface assembly 500 provides a worksurface 502 and a base 504. According to an exemplary embodiment, the worksurface has an elongated form with a length L and a width W. (according to other embodiments, the worksurface and worksurface assembly may have various other forms and shapes that provide an effective length and width).

Figure 2:
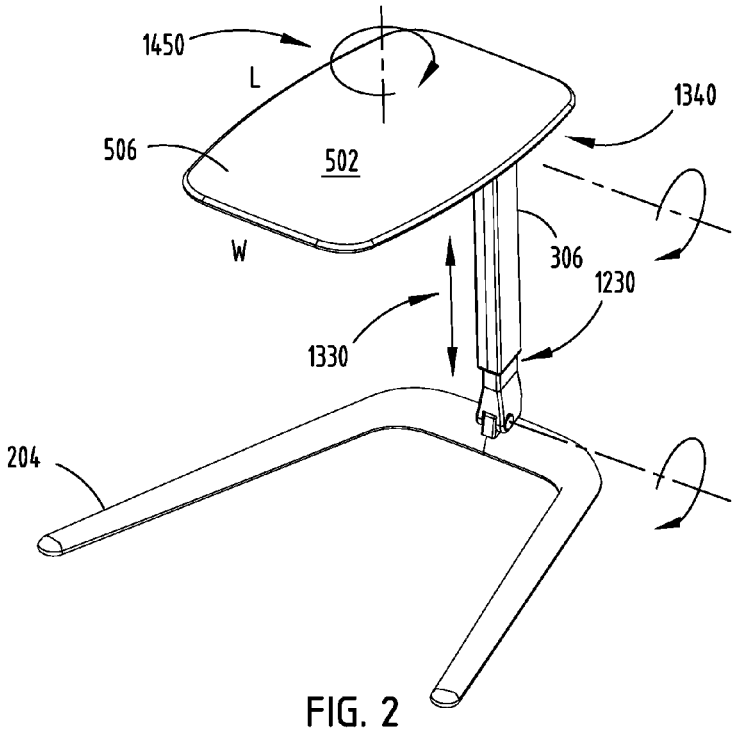
FIG. 2 is a front perspective view of the table according to an exemplary embodiment.
Figure 3:
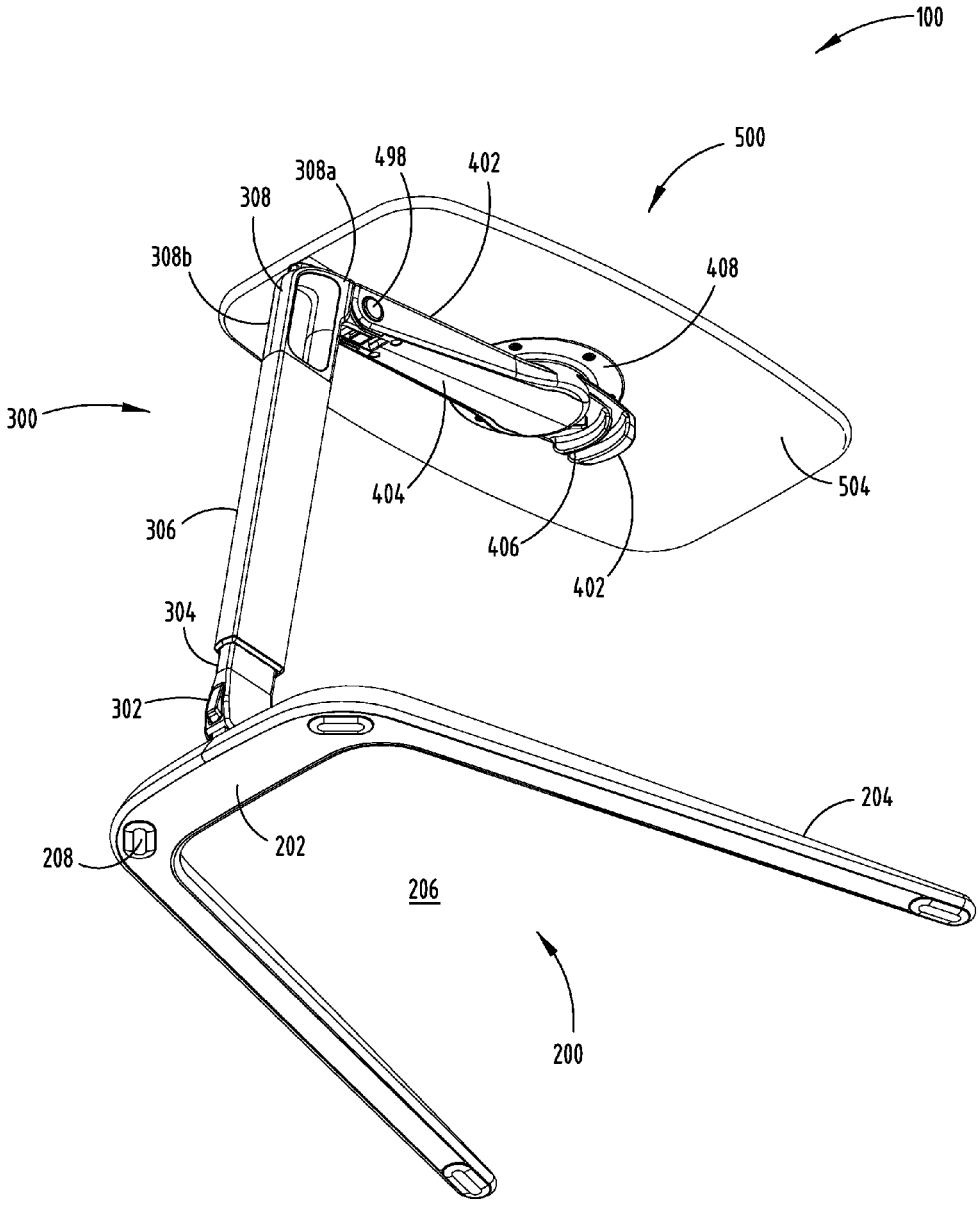
FIG. 3 is a bottom perspective view of the table according to an exemplary embodiment.
Figure 4:
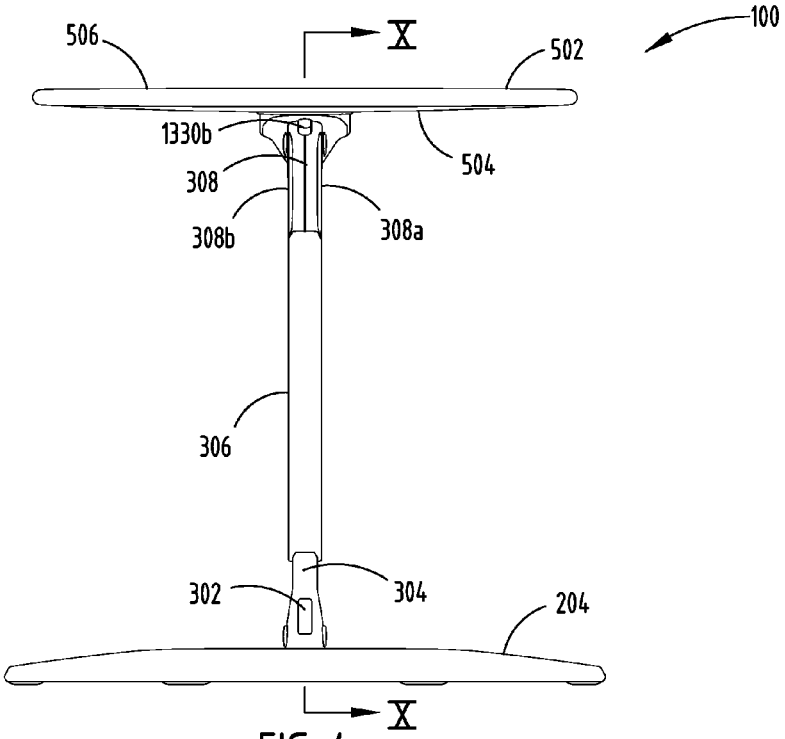
FIG. 4 is a rear elevation view of the table according to an exemplary embodiment.
Figure 5:
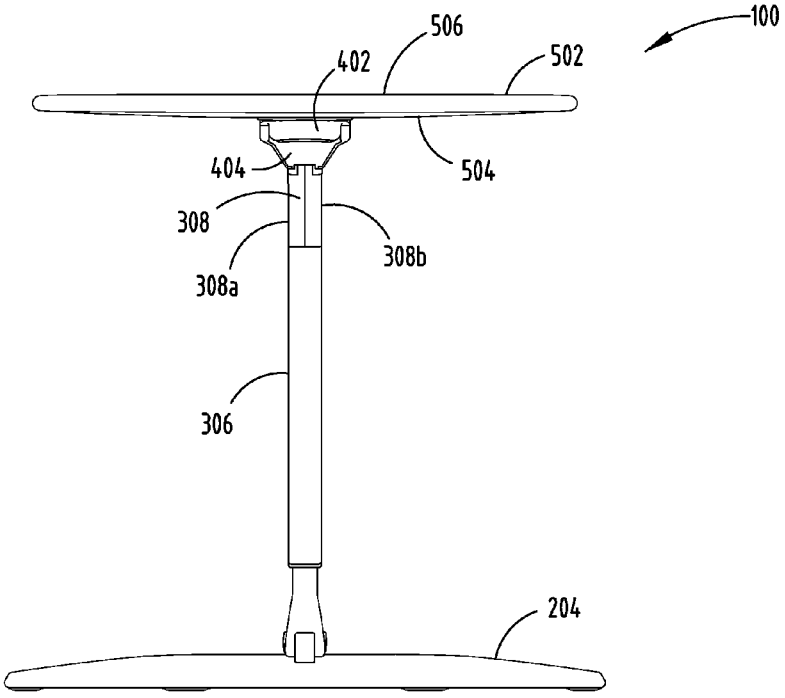
FIG. 5 is a front elevation view of the table according to an exemplary embodiment.
Figure 6:
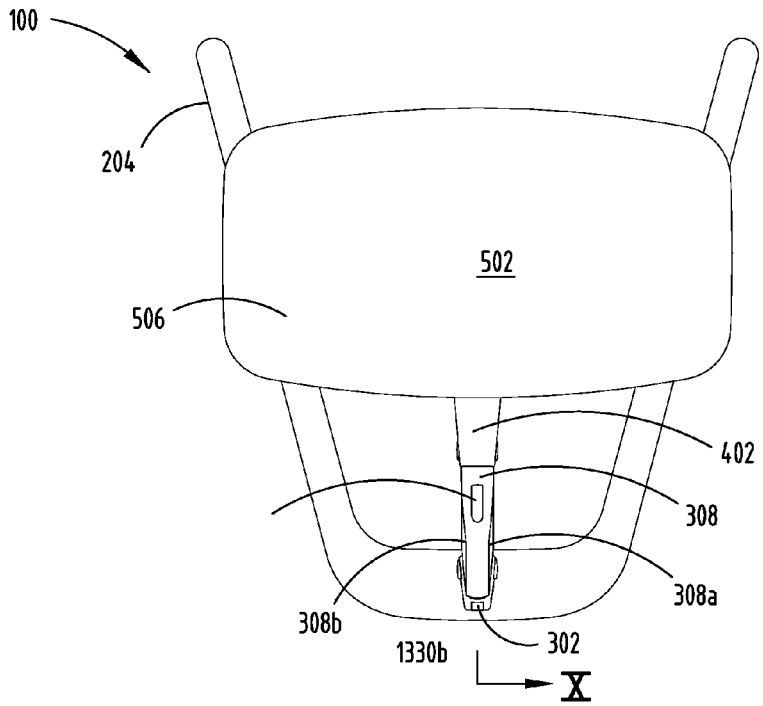
FIG. 6 is a top plan view of the table according to an exemplary embodiment.
Figure 7:
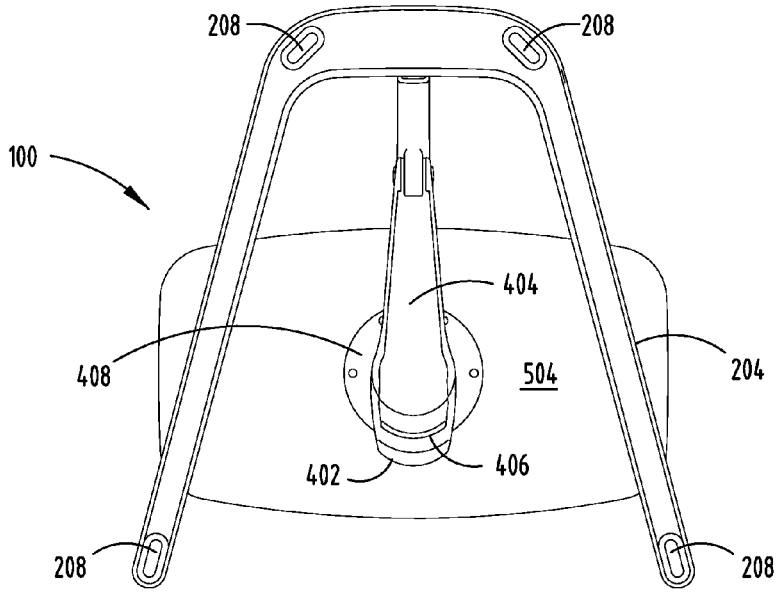
FIG. 7 is a bottom plan view of the table according to an exemplary embodiment.
Figure 10:
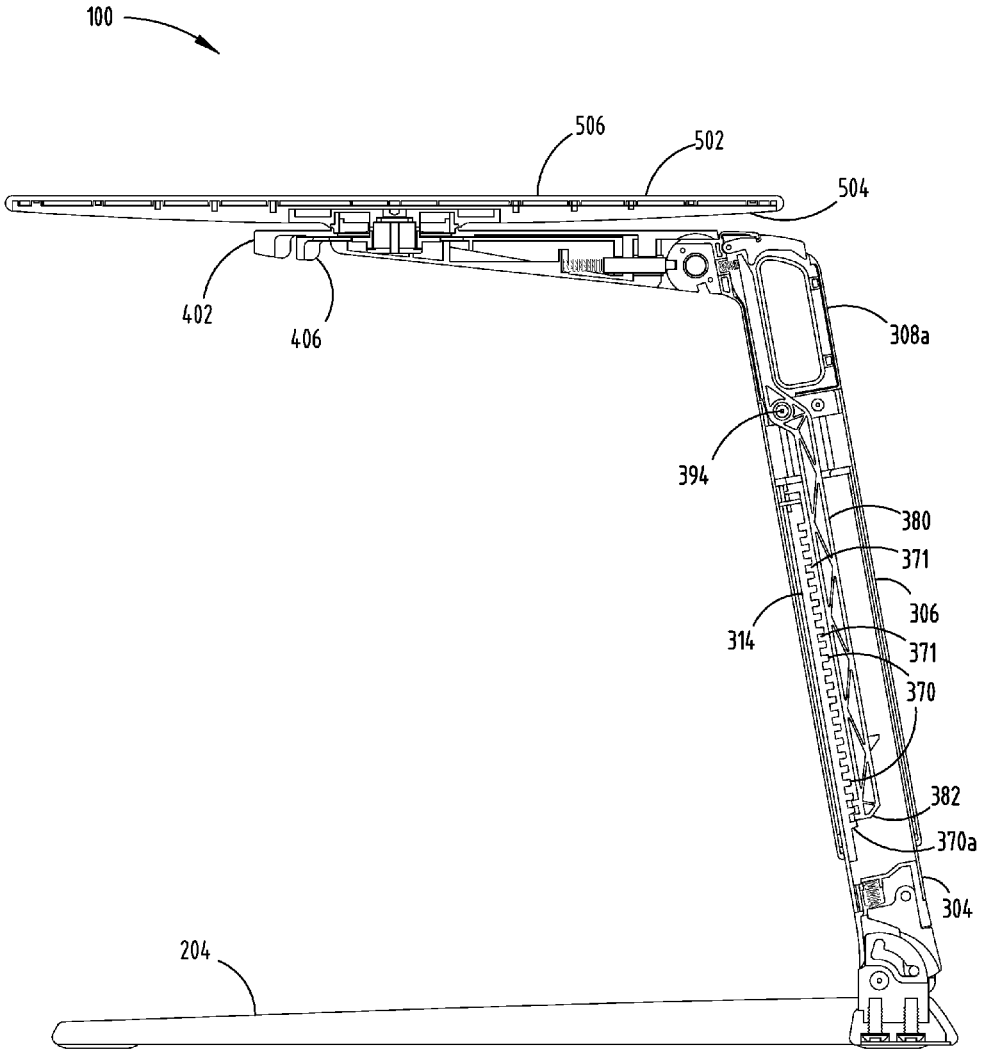
FIG. 10 is a cutaway side elevation view of the table according to an exemplary embodiment.

As indicated in FIGS. 2 and 10, table 100 provides four position adjustment mechanisms. Two of the adjustment mechanisms are generally for use when the table is in the deployed or use position: A pivot mechanism 1450 allows for the rotation of worksurface 500 relative to arm 400; a height adjustment mechanism 1330 within support 300 allows for adjustment of the height of worksurface 500 relative to base 200. Two of the adjustment mechanisms are for use to fold the table into the stowed position: A pivot mechanism 1340 allows for folding of arm 400 (with worksurface 500) into support 300; a pivot mechanism 1230 allows for folding of support 300 (with arm 400) and worksurface 500 into base 200. According to an exemplary embodiment, pivot mechanism 1450 for rotation of worksurface 500 relative to arm 400 is actuated by twisting worksurface 500 relative to arm 400 (to overcome a spring-biased holding force). Pivot mechanism 1230 for folding support relative to base 200 is actuated by button 1230*b* on post 302 (or by leverage exerted on support). Pivot mechanism 1340 for folding arm 400 onto support 300 is actuated by an actuator handle 406 (e.g. a release lever). Height adjustment mechanism 1330 for support 300 is actuated by button 1330*b* on handle 308.

Figure 8:
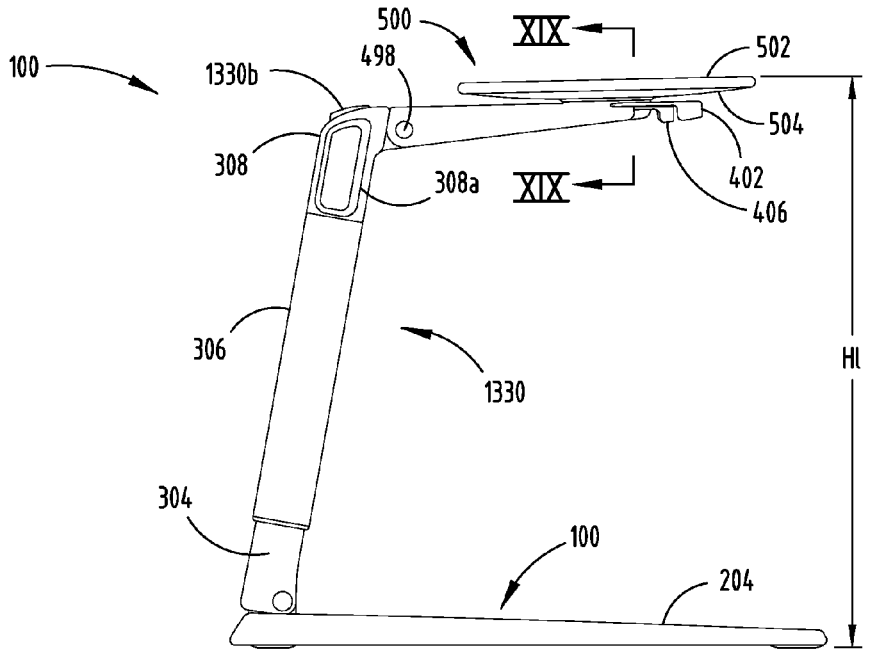
FIGS. 8 and 9 are side elevation views of the table according to an exemplary embodiment.
Figure 9:
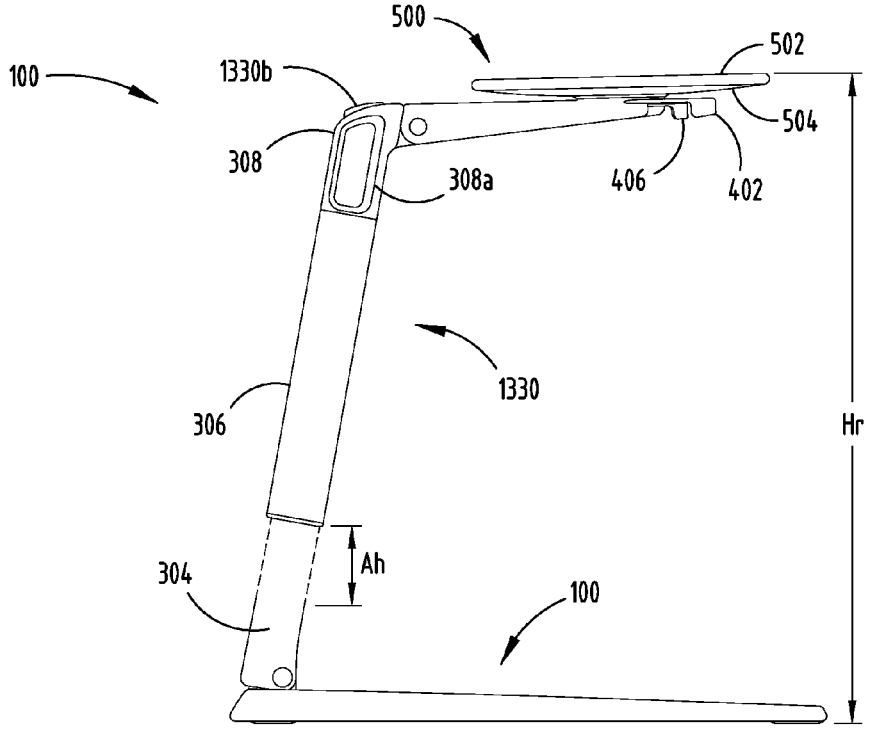

Referring to FIGS. 8 and 9, height adjustment of worksurface 500 relative to base 200 of table 100 is shown. The range of available height adjustment can be shown by comparison of the position of the support of the table in FIG. 8 and the position of the support of the table in FIG. 9 and the relative position of outer tube member 306 which is installed over and slides with respect to inner tube member 304. In FIG. 8, table 100 is shown with worksurface 500 at a lowered position relative to base 200 with a height of $H_L$; in FIG. 9, table 100 is shown with worksurface 500 in a raised position relative to base 200 with a height of $H_R$. The height adjustment range is indicated in FIG. 9 as $A_H$ (e.g. the difference between $H_L$ and $H_R$).

Figure 11:
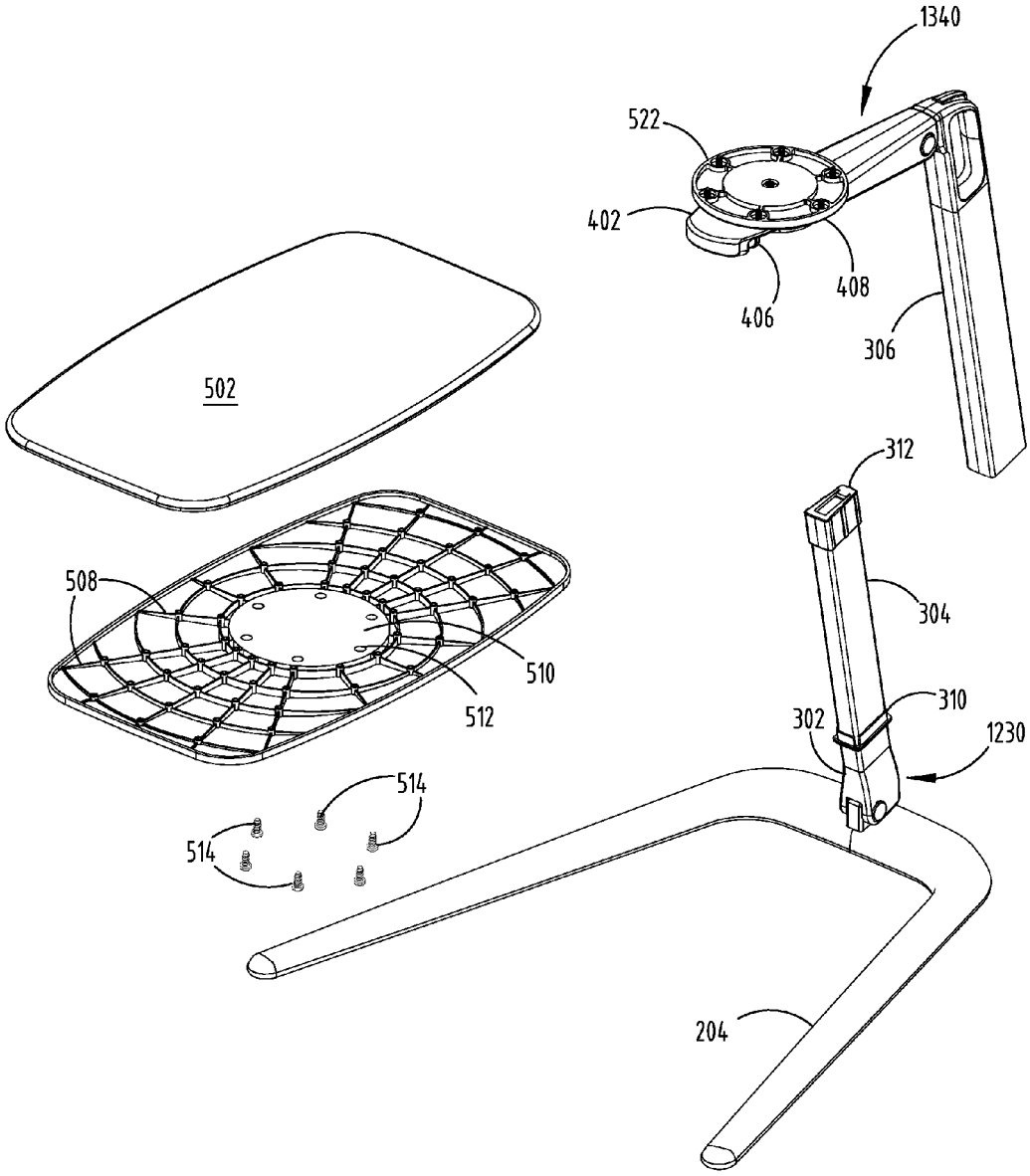
FIG. 11 is an exploded perspective view of the table showing the base and support according to an exemplary embodiment.
Figure 14A:
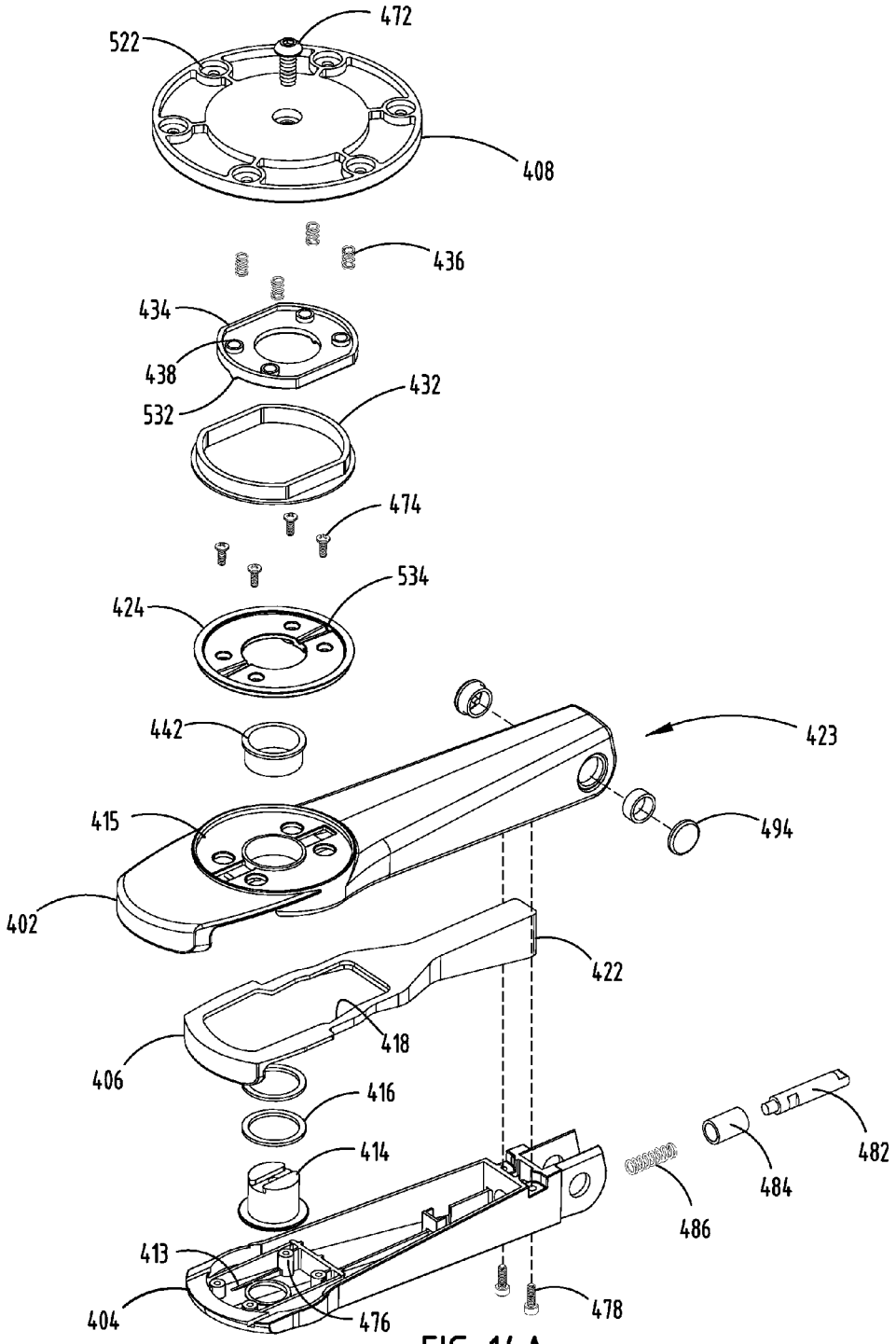
FIGS. 14A and 14B are exploded perspective views of the table showing components of the mechanisms for adjustment of the worksurface according to an exemplary embodiment.
Figure 14B:
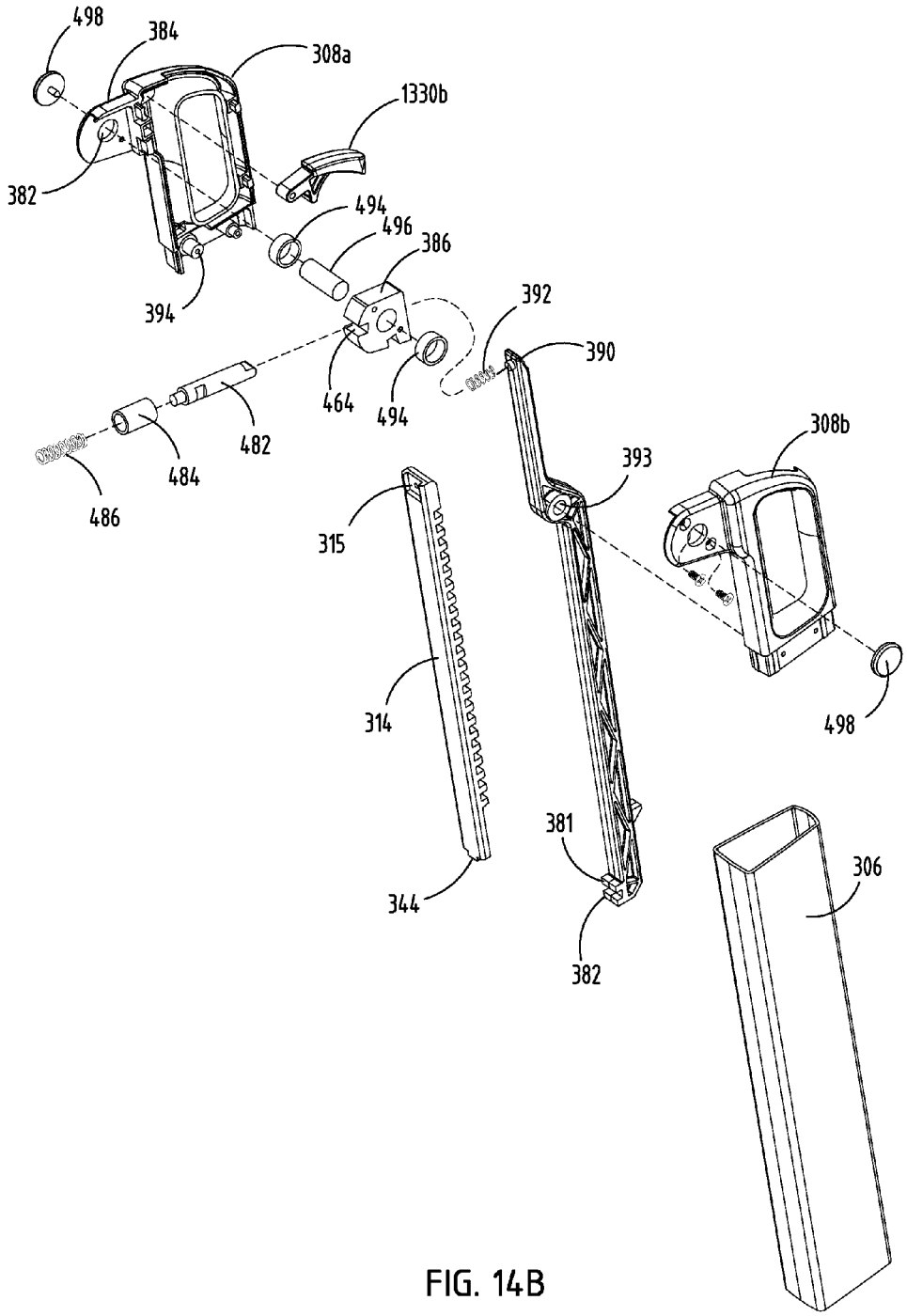

As shown in FIGS. 10 and 11 and 14B, height adjustment mechanism 1330 within support assembly 300 includes a rack 314 (with teeth 370) mounted within inner tube member 304 and a movable member shown as rod 380 (with a set of projections 382) mounted to outer tube member 306 on a pivot axle 394 installed within aperture 393. When outer tube member 306 is installed over inner tube member 304, projections 382 of rod 380 are configured to engage teeth 370 of rack 314 to retain the relative position of outer tube member 306 to inner tube member 304. Rod 380 engages rack 314 under the biasing force of a coil spring 392 acting (as seated) at a tip 390 of rod 380; the biasing force of coil spring 392 can be overcome to disengage rod 380 from rack 314 by actuating button 1330*b* (e.g., sliding button forward to compress coil spring 392 and to pivot rod 380 at post 394 so that projections 382 of rod 380 are disengaged from contact with teeth 370 of rack 314). Outer tube member 306 when disengaged from inner tube member 304 (e.g. by depressing button 1330*b* to disengage rod 380 and rack 314) can be adjusted to a different height; outer tube member 306 can be reengaged with inner tube member 304 (e.g. by releasing button 1330*b* so that rod 380 and rack 314 are reengaged).

Referring to FIG. 11, a partially exploded view of worksurface assembly 500 and support assembly 300 is shown. Worksurface assembly 500 includes a top portion 502 providing a worksurface 506 and a base plate 504 (having a rigidification structure comprising web 508) and a mounting area 510. Mounting area 510 provides apertures 512 through which fasteners such as screws 514 can be inserted to install worksurface assembly 500 to mounting plate 408 of arm assembly 400 (e.g. screws inserted through corresponding apertures 522).

Outer tube member 306 and handle 308 of support assembly 300 are attached to arm assembly 400 and then installed over a cap 312 onto inner tube member 304 of support assembly 300. Inner tube member 304 of support assembly 300 is secured to base 300 by insertion on post 302 with a trim piece 310. Support assembly 300 is coupled at one end to arm assembly 400 and at the other end to base 200.

Figure 12:
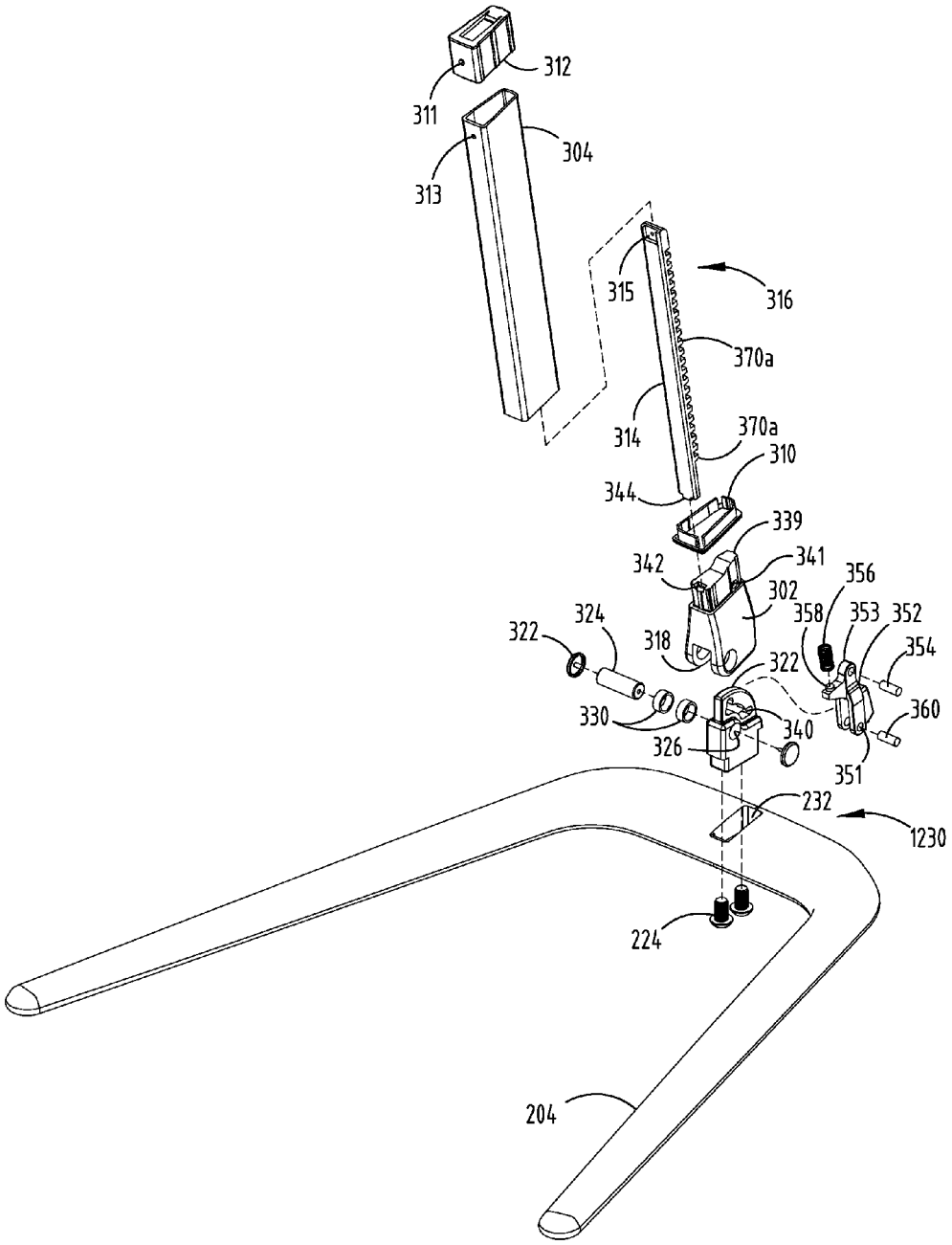
FIG. 12 is a fragmentary exploded perspective view of the table according to an exemplary embodiment.
Figure 13:
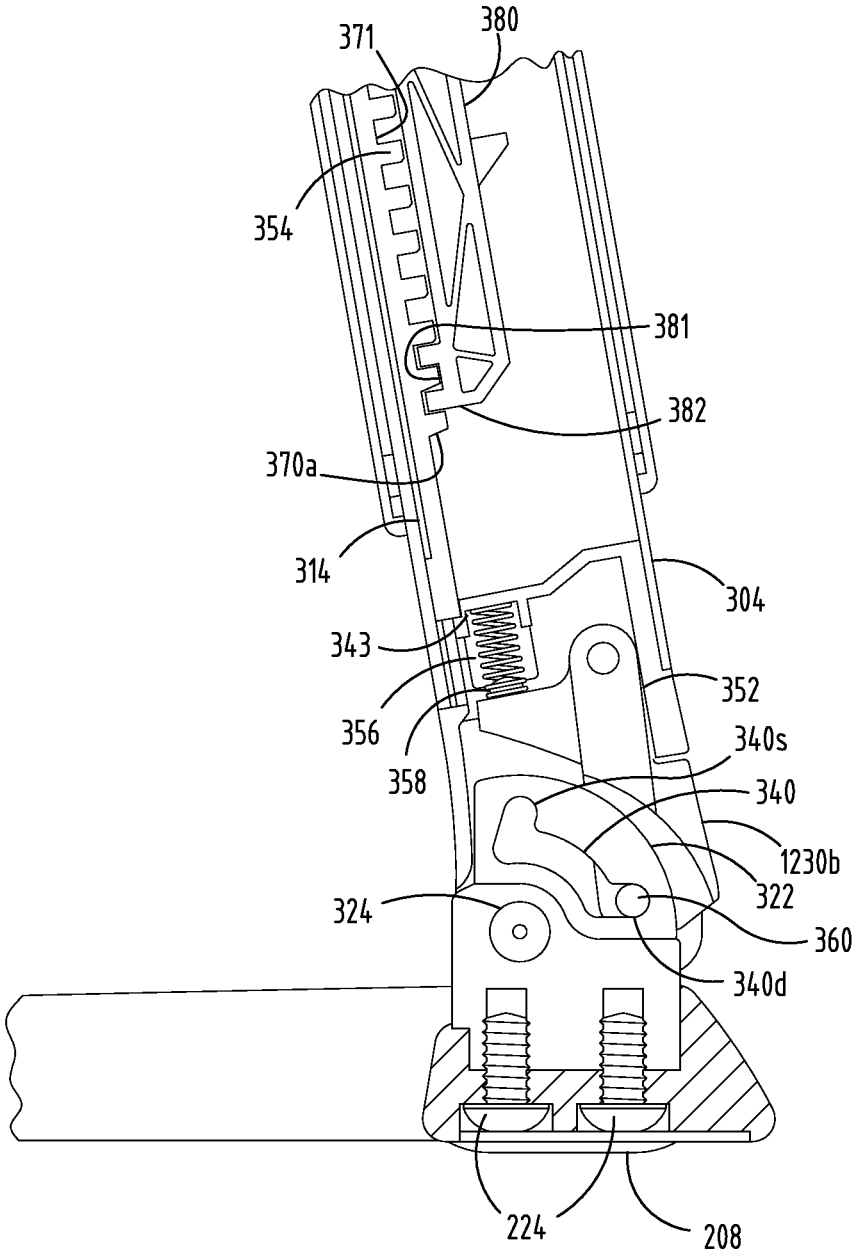
FIG. 13 is a fragmentary cutaway view of the table showing the connection of the base and support according to an exemplary embodiment.

Referring to FIGS. 12 and 13, the mounting of support assembly 300 onto base 200 is shown. As shown in FIG. 12, a mounting bracket 322 is inserted into a notch 232 of base 200 and secured by fasteners shown as bolts 234. Mounting bracket 322 provides a curved slot 340 having a notch 340*s* at one end and a notch 340*d* at the other end; mounting bracket 322 also provides an aperture 326. A pivot bracket 352 provides a clevis 351 providing a set of apertures 347 and a flange 353 with an aperture 349 for coupling to post 302. Clevis 315 of pivot bracket 352 is installed onto mounting bracket 322 and secured with a pin 360 fitting through curved slot 340 to attach pivot bracket 352 to mounting bracket 322. A coil spring 356 is installed on a seat 358 on pivot bracket 352. Flange 353 of pivot bracket 352 is installed within post 302 by an axle or pin 354 secured through an aperture 341 of post 302; when pivot bracket 352 is installed within post 302 coil spring 356 is seated in a notch 343 within post 302 (as shown in FIG. 13).

Post 302 includes a clevis 318 that is installed onto mounting bracket 322 and secured by an axle 324 and bushings 330 and with an end cap 332 (at each end). Clevis 318 and axle 324 couple post 302 to bracket 322 for pivot mechanism 1230 (coupling support 300 to base 200). As shown in FIG. 13, the biasing force provided by spring 356 of pivot bracket 352 within post 302 acts upon pin 360 coupled to mounting bracket 322; spring 356 urges pin 360 into engagement with notch 340*s* when pivot mechanism 1230 is in the stowed position or into engagement with notch 340*d* when pivot mechanism 1230 is in the deployed position. (An exposed surface of pivot bracket 352 functions as button 1230*b* of pivot mechanism 1230). When support 300 is to be moved from the stowed position to the deployed position, actuation of button 1230*b* overcomes the biasing force of spring 356 and will release pin 360 from engagement with notch 340*s* or 340*d* (respectively) and allow pin to travel along curved slot 340 as support 300 (on post 302) pivots on axle 324 with respect to base 200 between the stowed position and the deployed position. See FIG. 13. (Notches of slot 340 can be configured so that biasing force of spring 356 may also be overcome with a sufficient force acting by leverage through support 300, e.g. on outer tube member 306.)

As shown in FIGS. 12 and 13, post 302 provides a plug or cap 339 onto which the bottom of inner tube member 304 can be press fit; cap 339 also provides a seat or notch 342 into which a projection 344 on the bottom of rack 314 can be installed to secure the bottom of rack 314 within inner tube member 304. Top of rack 314 is secured to inner tube member 304 by a fastener shown as screw 316 installed through an aperture 315 in rack 314, an aperture 311 in cap 312 and an aperture 313 in inner tube member 304.

As shown in FIGS. 10 and 13, height adjustment mechanism 1330 includes rack 314 having a series or set of teeth 370 forming notches 371 and a rod or bar 380 having a set of projections 382 forming a notch 381. As shown, in rack 314 between each pair of teeth 370 is a notch 371; in rod 380 a set of projections 382 is separated by a notch 381. The set of projections 382 of rod 380 engage and disengage the set of teeth 370 of rack 314 (see also FIG. 10) to provide height adjustment mechanism 1330 of support 300 so that the worksurface of the table can be retained at (a) a raised height relative to the base and (b) at a lowered height relative to the base and (c) a plurality of heights in between the raised height and the lowered height. According to an exemplary embodiment, when the worksurface is in the raised height the rack and the bar are engaged in a position with the projection of the bar engaged in one set of teeth of the rack; as the worksurface height is lowered the rack and the bar can be engaged in other positions with the projection of the bar in a other sets of teeth of the rack.

Figure 21:
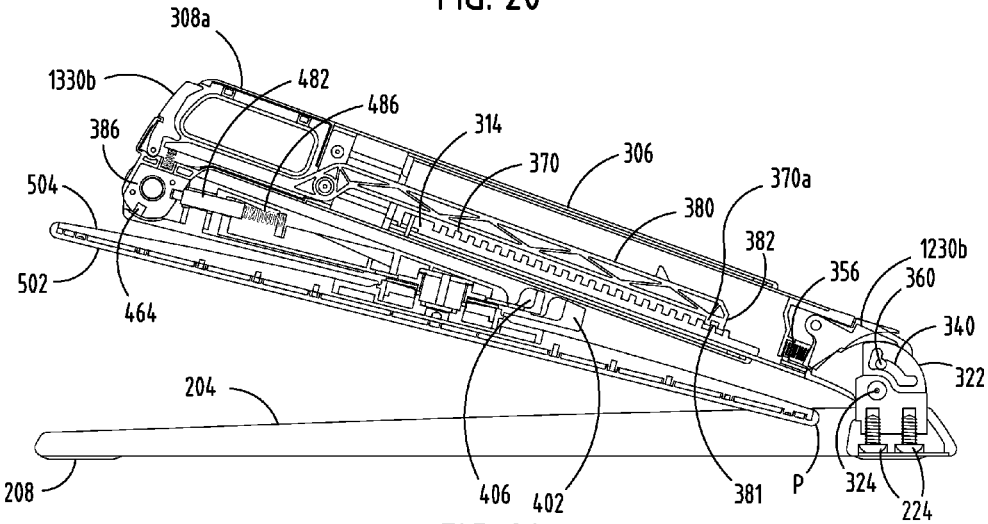
FIG. 21 is a cutaway side elevation view of the table in a partially stowed position according to an exemplary embodiment.
Figure 22:
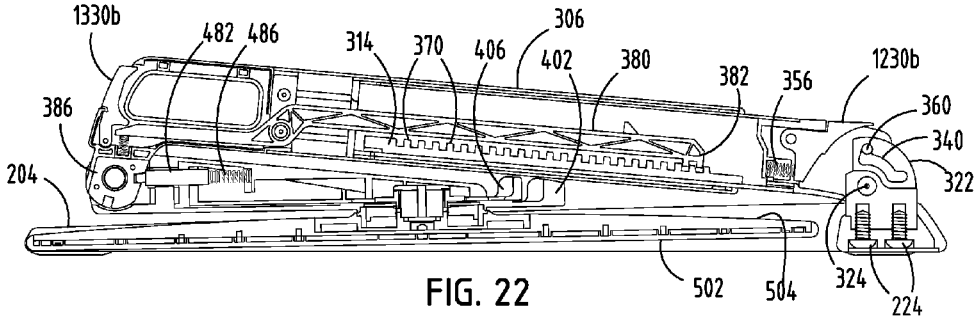
FIG. 22 is a cutaway side elevation view of the table in a stowed position according to an exemplary embodiment.
Figure 23:
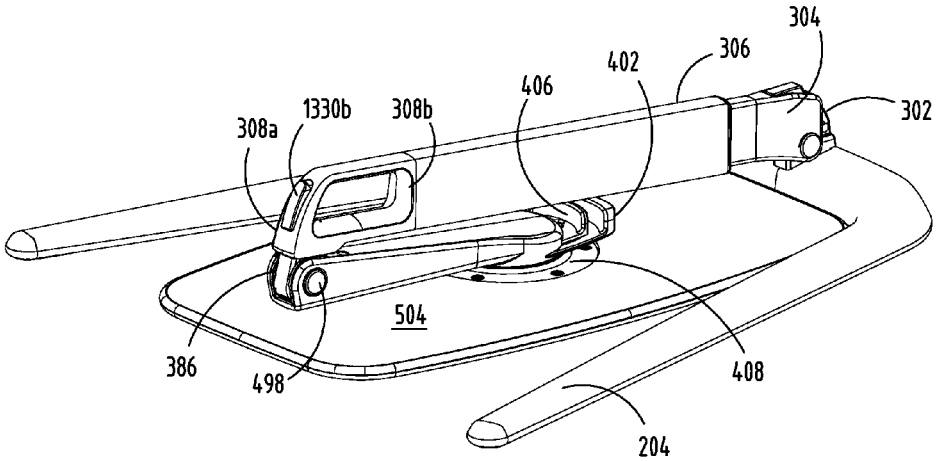
FIG. 23 is a top perspective view of the table in a stowed position according to an exemplary embodiment.
Figure 24:
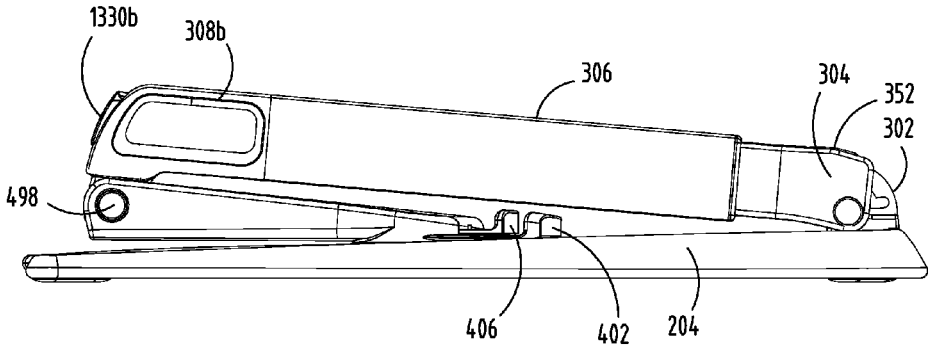
FIG. 24 is a side elevation view of the table in a stowed position according to an exemplary embodiment.
Figure 25:
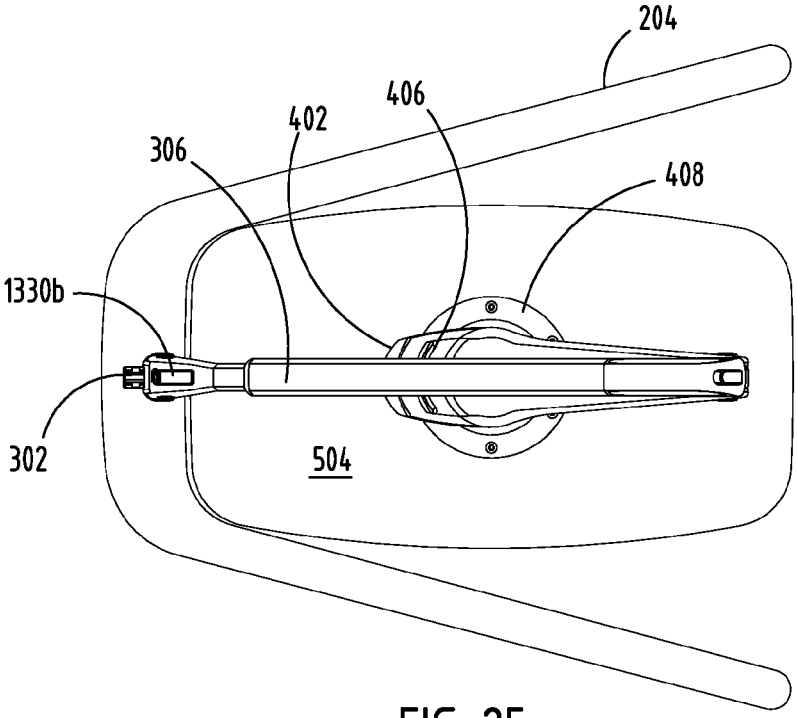
FIG. 25 is a bottom plan view of the table the stowed position according to an exemplary embodiment.
Figure 26:
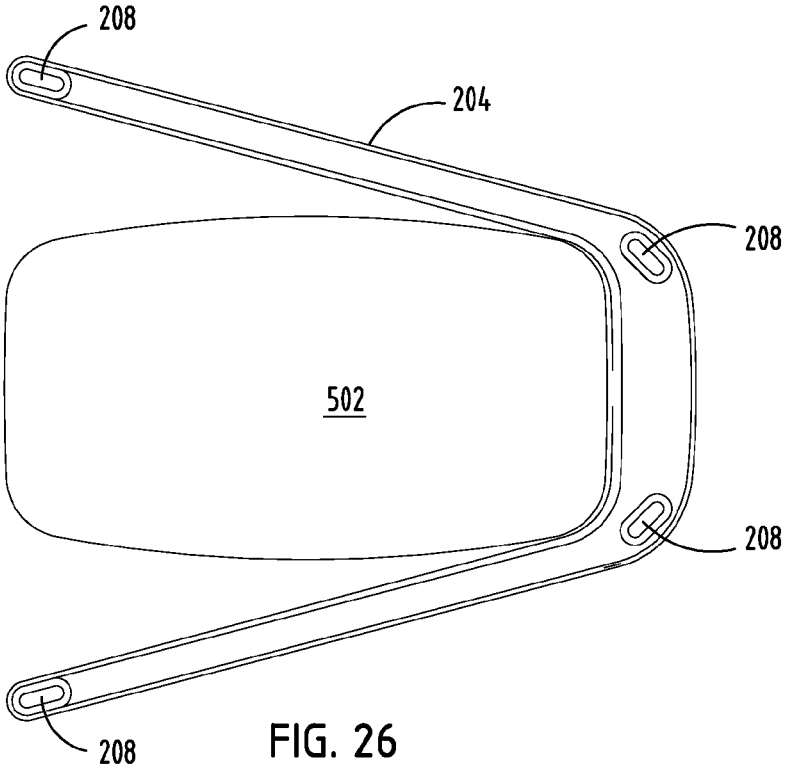
FIG. 26 is a top plan view of the table in a stowed position according to an exemplary embodiment.
Figure 27:
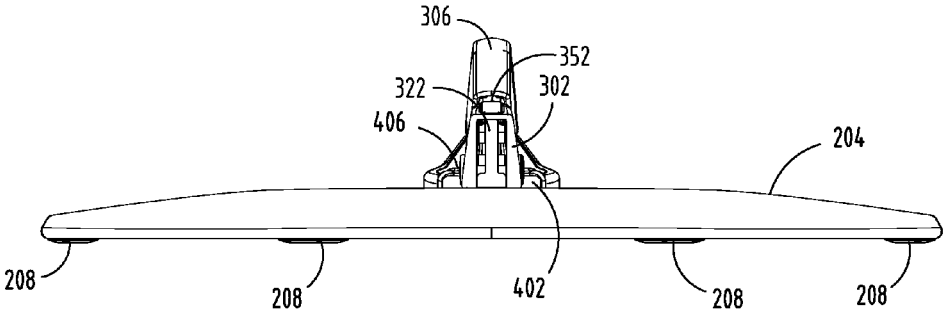
FIG. 27 is a front elevation view of the table in a stowed position according to an exemplary embodiment.
Figure 28:
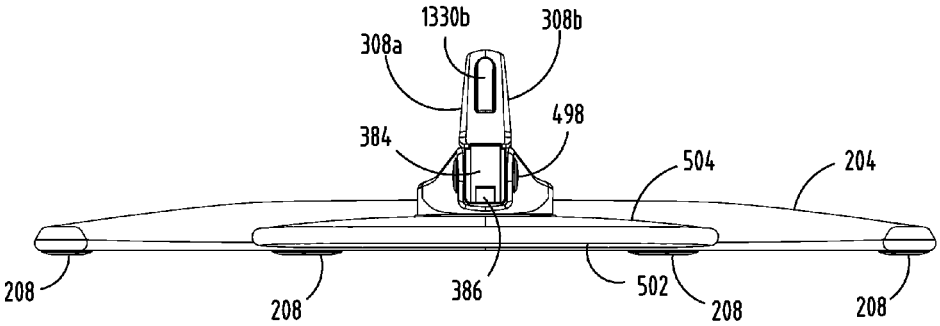
FIG. 28 is a rear elevation view of the table in the stowed position according to an exemplary embodiment.

Referring to FIG. 13 and FIGS. 21-22, according to an exemplary embodiment, rack 314 has a leading or first tooth 370*a* with a profile (e.g., a generally angled as shown and in any event different than other teeth 370 of rack 314 that have a generally "squared" profile and form a notch to more firmly seat the projection). The profile of first tooth 370*a* is configured to facilitate movement of projection 382 of rod 380 over and past first tooth 370*a* and into an adjacent first notch 371*a* to first tooth 370*a* when rod 380 is back-driven with respect to rack 314. According to an exemplary embodiment, to prepare the table to be folded into the stowed position, the height adjustment mechanism is initially in the lowest height position (see FIG. 21) with projection 382 of rod 380 at a position beyond first tooth 370*a* of rack 314. Referring to FIGS. 21 and 22, as support 300 of the table is folded to the stowed position, the leading edge of worksurface 500 engages the central portion of base 200 at point P and a force is developed tending to back-drive rod 380 relative to rack 314. When rod 380 is back-driven by the force developed at point P, a leading edge of projection 382*a* of rod 380 is able to travel along the profile of first tooth 370*a* (e.g. angled profile as shown or curved/other profile according to alternative embodiments) so that projection 382 can move into engagement with an adjacent notch 371*a* corresponding to a "home" position for storage of the table. According to any preferred embodiment, the height adjustment mechanism is configured so that the profile of the first tooth and the force developed at point P are in cooperation sufficient to allow the rack and the rod to be back-driven into the "home" position (i.e. without the need to actuate button for the height adjustment mechanism). The profile of the teeth on the rack "above" the home position has a different profile from that of the first tooth of the rack to prevent back-driven motion when the table is set at higher positions. The profile of more teeth between the home position and the first tooth may need to have the same angled profile, if a home position is chosen further from the lowest possible position than that shown.

Referring to FIG. 14A, arm assembly 400 is shown in an exploded perspective view. Arm assembly 400 includes a bottom portion 404 and a top portion 402 with an actuator member 406 and a mounting plate 408. According to an exemplary embodiment, actuator member 406 is installed between and slidable relative to top portion 402 and bottom portion 404; mounting plate 408 is installed onto and rotatable relative to top portion 402.

As shown in FIGS. 1-2, 14A and 18-19, arm assembly 400 includes a fixed portion and a movable portion. Fixed portion of arm assembly 400 includes top portion 402 and bottom portion 404. An axle 414 having washers 416 is installed within a recess 413 in bottom portion 404; axle 414 fits through an opening 418 in actuator member 416 and through an aperture 415 in top portion 404 to form a hub of arm assembly 400 (e.g. for pivot mechanism 1450 of worksurface assembly 500). A lock/bearing plate 428 is secured within a recess 424 of top portion 402 by fasteners shown as screws 474 installed through apertures and into posts 476 in bottom portion 404 of arm assembly 400. Plate 428 provides two notches or grooves 534 fit within recess 424. Top portion 404 is secured to bottom portion adjacent clevis 423 by fasteners shown as screws 478. Top portion 404 and bottom portion 402 and plate 428 as assembled substantially comprise a fixed or stationary portion of arm assembly 400. See FIGS. 18 and 19.

Figure 18:
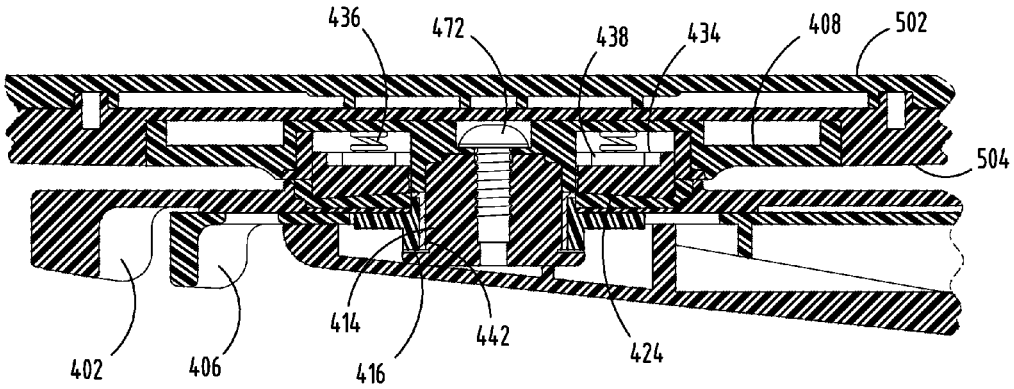
FIG. 18 is a fragmentary cutaway side elevation view of the mechanism for pivotal adjustment of the worksurface of the table according to an exemplary embodiment.
Figure 19:
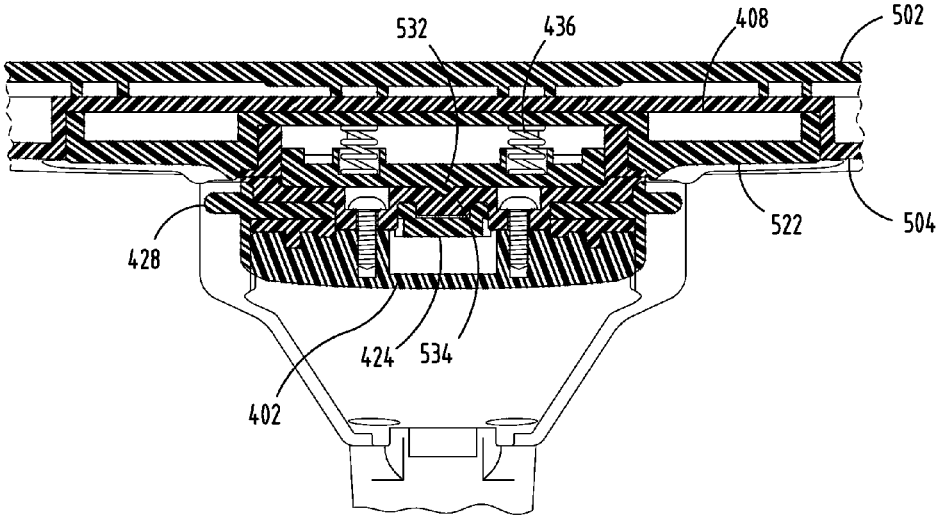
FIG. 19 is a fragmentary cutaway front elevation view of an adjustment mechanism of the table according to an exemplary embodiment.
Figure 20:
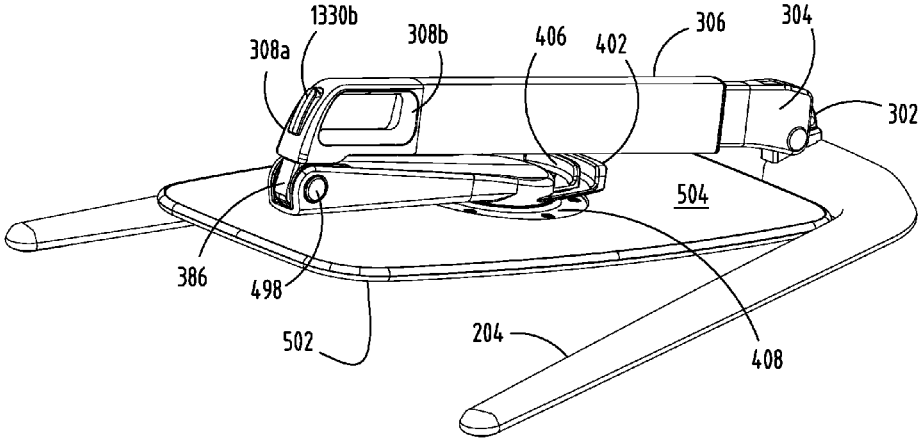
FIG. 20 is a top perspective view of the table in a partially stowed position according to an exemplary embodiment.

Referring to FIGS. 14A and 18-19, movable portion of arm assembly 400 comprises mounting plate 408 and a coupling plate 434. Coupling plate 434 is positioned between mounting plate 408 and lock/bearing plate 428 within a washer 432 as to allow for rotation of (movable) coupling plate 434 relative to (fixed) bearing plate 428 around the hub of arm assembly 400. Coupling plate 434 provides an array of seats 438 for an array of coil springs 436 that provide a biasing force acting on mounting plate 408 within the hub of arm assembly 400. Coupling plate 434 provides two projections shown as teeth 532 that generally correspond in profile to the profile of the grooves 534 in lock/bearing plate 428 (see FIG. 19). Axle 414 projects from top portion 404 through a central aperture in lock/bearing plate 428 and through a central aperture in coupling plate 434. Mounting plate 408 for worksurface assembly 500 is secured to axle 414 through coupling plate 434 and through lock/bearing plate 428 and top portion 402 of arm assembly 400 with a fastener shown as bolt 472 to substantially comprise pivot mechanism 1450. Securing of bolt 472 within axle 414 compresses coil springs 436 so that when teeth 532 of plate 434 are rotated into engagement with corresponding grooves 534 of plate 428 the biasing spring force will tend to retain teeth 532 within grooves 534 unless and until rotated or twisted out of engagement by rotation and twisting of the worksurface assembly relative to the arm assembly, (see FIGS. 18 and 19). According to a preferred embodiment, the teeth of the coupling plate and the grooves of the lock plate will be configured for engagement when the worksurface has been rotated into the stowed position; engagement of the teeth and grooves will provide audible feedback (i.e. a "click" sound) as well as physical feedback (i.e. a "locking" effect that can be overcome upon application of a "twisting" force generally greater than required to reposition/rotate the worksurface when the teeth and grooves are not engaged).

Figure 15:
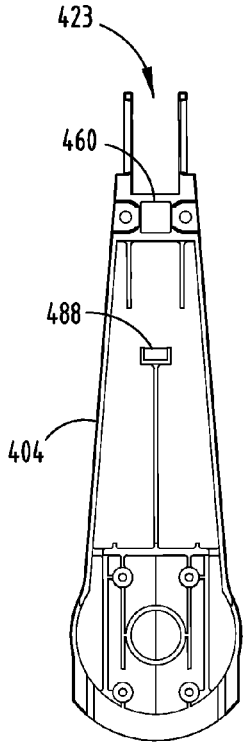
FIG. 15 is a bottom plan view of the arm for the worksurface of the table according to an exemplary embodiment.
Figure 16:
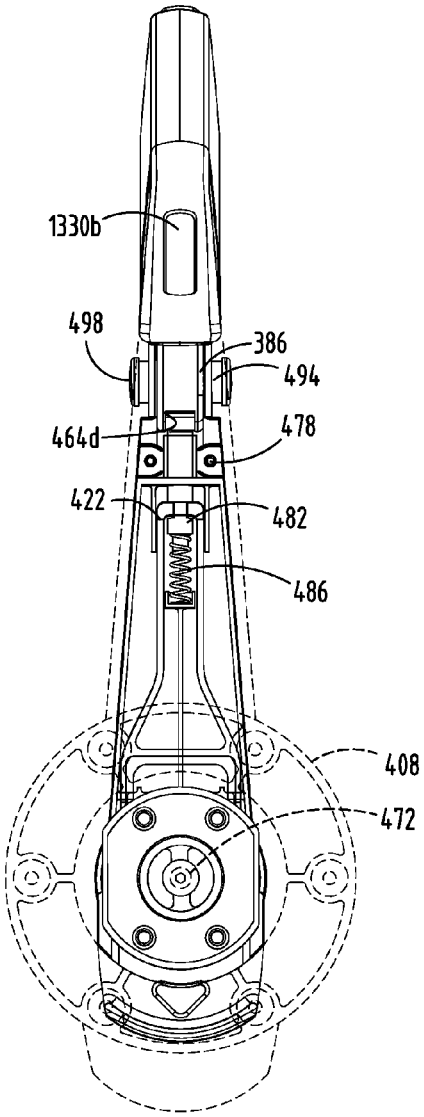
FIG. 16 is a fragmentary top plan view of the table showing the arm and adjustment mechanism for the worksurface according to an exemplary embodiment.
Figure 17:
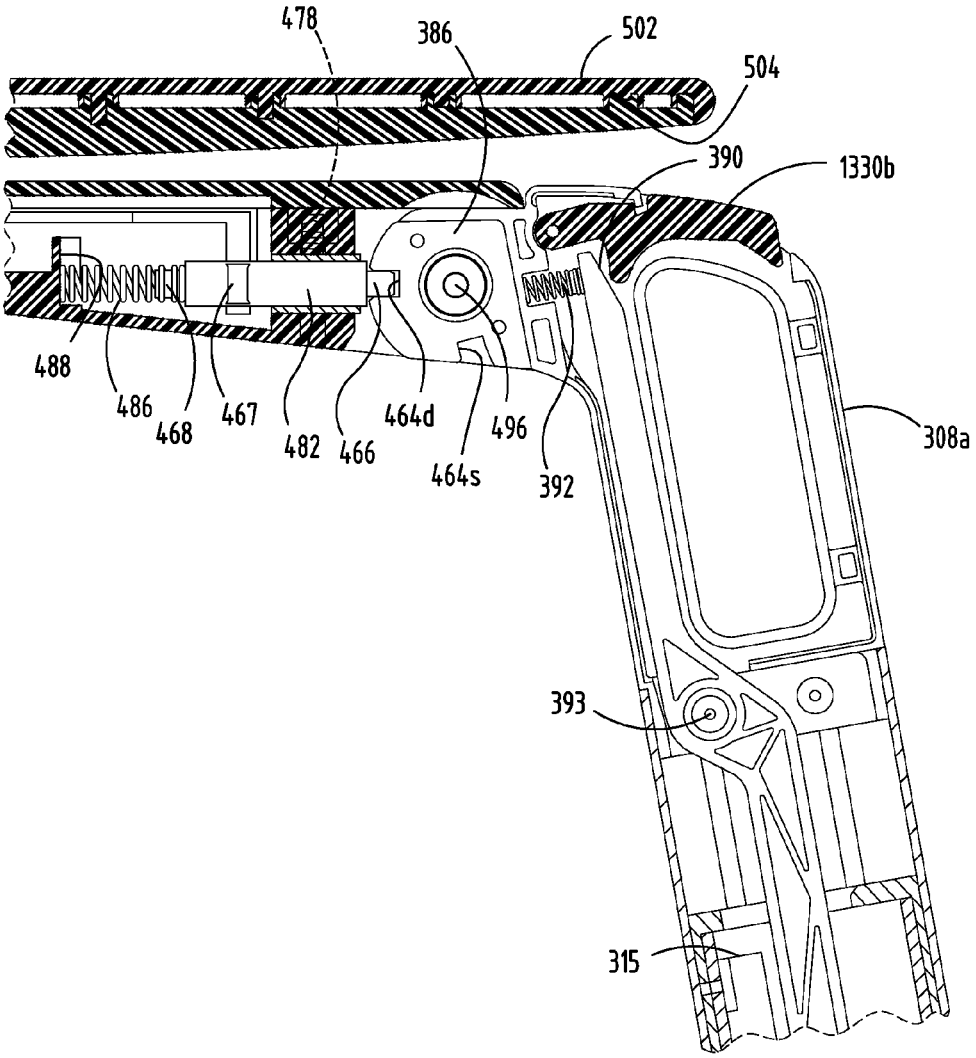
FIG. 17 is a fragmentary cutaway of the mechanism for showing the worksurface of the table according to an exemplary embodiment.

Pivot mechanism 1340 for arm assembly 400 relative to support assembly 300 is shown in FIGS. 14A and 15 through 17 according to an exemplary embodiment. As shown in FIGS. 14A and 15-16, top portion 402 of arm assembly has a clevis 423 that fits onto a hub 386 mounted to support assembly 300. As shown in FIGS. 15 and 16, clevis 423 of arm assembly 400 is pivotally coupled to hub 386 of support assembly 300 by a pin or axle 496 retained by end caps 498. As shown in FIG. 14A, actuator member or handle 406 is installed between top portion 402 and bottom portion 404 of arm assembly 400. Actuator member 406 provides a handle 405 at one end and a catch 422 at the opposite end. Pivot mechanism 1340 includes a spring-loaded detent mechanism installed within bottom portion or base 404 of arm assembly 400; the detent mechanism includes a post or pin 482 providing a seat for a coil spring 486 at one end and a generally squared tip 466 at the other end. Pin 482 also provides a notch 467 for engagement with catch 422 of actuator handle 406. Pin 482 is secured within bottom portion 404 of arm assembly 400 for sliding or translating movement with engagement by actuator handle 406. Pin 482 is installed through a passage or tube 460 (e.g. busing) within bottom portion 404; spring 486 when seated on pin 482 is installed into a seat 488 on bottom portion 404. Tip 466 of pin 482 engages with a set of notches in hub 386. According to an exemplary embodiment, hub 386 provides a notch 464*d* that is engaged by tip 466 of pin 482 when arm assembly 400 is in the deployed position for use and a notch 464*s* that is engaged by tip 466 of pin 482 when arm assembly 400 is in the stowed position for storage. According to any preferred embodiment, the tip of the pin is retained in the notch of the hub under a biasing force provided by the coil spring unless and until the tip is retracted from the notch by application of a suitable force (i.e. pulling force to compress the spring by action of the catch on the notch of the pin) applied to the actuator handle. Freedom of movement of actuator member 406 is facilitated by a guide 410 in bottom portion 404 and a tab 437 configured to prevent binding or undue resistance from top portion 402 during sliding movement.

Referring to FIG. 14B, upper portion of support assembly 300 includes a two-piece handle assembly 308 along with button 1330*b*. Within support assembly 300, outer tube member 306 with rod 380 and inner tube member 304 with rack 314 comprise height adjustment mechanism 1330 (actuated with button 1330*b*); hub 386 within handle assembly 308 engaging clevis 423 of top portion 402 of arm assembly 400 comprises pivot mechanism 1340 (actuated with handle 406).

Handle assembly 308 includes two handle members 308*a* and 308*b* that are secured together by fasteners (e.g. screws) to entrap and secure rod 380 (pivotally on a post 394) and hub 386 (secured by fasteners such as pins or screws). Handle assembly is installed onto top portion of outer tube member 306. Hub 386 fits onto axle 486 which extends through apertures 382 in flanges on handle members 308*a* and 308*b*. Rod 380 attaches between the handle members through aperture 390 onto post 394. Handle assembly 308 with rod 380 and hub 386 is installed within outer tube structure 306. Rod 380 is installed within handle assembly by a pivot axle 394 inserted through aperture 392. Pivot axle 486 for hub 386 is secured within the handle assembly by bushings 494 and end caps 498.

It is important to note that the construction and arrangement of the elements of the inventions as described in system and method and as shown in the figures above is illustrative only. Although some embodiments of the present inventions have been described in detail in this disclosure, those skilled in the art who review this disclosure will readily appreciate that many modifications are possible without materially departing from the novel teachings and advantages of the subject matter recited. Accordingly, all such modifications are intended to be included within the scope of the present inventions. Substitutions, modifications, changes and omissions may be made in the design (including materials of construction), variations made in the arrangement or sequence of process/method steps or operating conditions and arrangement of the preferred and other exemplary embodiments without departing from the spirit of the present inventions.

The invention claimed is:

1. An article of furniture configured to be deployed in a generally upright use position and to be folded into a generally compact stowed position comprising:

a base comprising a center portion and two legs, the two legs extending from the center portion;

a support coupled to the base;

an arm coupled to the support;

a worksurface coupled to the arm and comprising a length and a width;

a first pivot mechanism coupling the support to the base so that the support can be pivoted relative to the base and folded from a generally vertical orientation in the use position to a generally horizontal orientation for the stowed position;

a second pivot mechanism coupling the arm to the support so that the arm can be rotated relative to the support and folded from a generally horizontal orientation in the use position to a generally vertical orientation for the stowed position; and a third pivot mechanism coupling the worksurface to the arm so that the worksurface can be rotated relative to the base when in the use position;

wherein in the stowed position the worksurface folds into alignment with the support, the support folds into alignment with the legs of the base, and the width of the worksurface fits within a cavity defined by an inner edge of each of the two legs and the center portion of the base such that the majority of the worksurface is substantially coplanar with a plane defined by the cavity.

2. The article of furniture of claim 1 wherein the support comprises a height adjustment mechanism so that the worksurface can be presented at (a) a lowered height relative to the base and (b) a raised height relative to the base and (c) a plurality of heights in between the lowered height and the raised height.

3. The article of furniture of claim 2 wherein the height adjustment mechanism comprises a rack having a series of teeth and notches and a bar having a projection configured to fit within at least one of the notches between the teeth on the rack so that the bar can be retained in a determined position relative to the rack to retain the worksurface at a corresponding height.

4. The article of furniture of claim 3 wherein (a) when the worksurface is in the lowered height the rack and the bar are in a first position with the projection of the bar adjacent to a first tooth of the rack and (b) when the worksurface is in the raised height the rack and the bar are engaged in a second position.

5. The article of furniture of claim 4 wherein the height adjustment mechanism is configured so that when the support is folded to the stowed position, the bar is engaged in a home position adjacent to the lowered position and between the lowered position and the raised position with the projection of the bar engaged within a first notch of the rack adjacent the first tooth of the rack; and wherein the first tooth of the rack has a profile so that when the support is folded the projection of the bar is able to travel along the profile of the first tooth and toward the home position so that the projection of the bar can be engaged within the first notch of the rack.

6. The article of furniture of claim 5 wherein the rack and the bar are configured to fit releasably in the lowered position and to engage securely in the home position when the support is folded to the stowed position.

7. The article of furniture of claim 6 wherein the teeth on the rack between the home position and the raised position have a different profile from that of the first tooth of the rack.

8. The article of furniture of claim 1 wherein the length of the worksurface fits substantially within the cavity of the base when in the stowed position.

9. The article of furniture of claim 1 wherein the length of the worksurface is greater than the width of the worksurface.

10. The article of furniture of claim 1 wherein a top surface of the worksurface in the use position becomes a bottom surface in the stowed position.

11. The article of furniture of claim 10 wherein in the stowed position, at least a portion of the bottom surface of the worksurface is approximately in plane with bottom surfaces of the legs of the base.

12. An article of furniture configured to be deployed to a use position and to be folded into a stowed position comprising:

a base;

a support coupled to the base;

an arm coupled to the support;

a worksurface coupled to the arm;

a first pivot mechanism coupling the support to the base so that the support can be pivoted relative to the base and folded from a generally vertical orientation in the use position to a generally horizontal orientation for the stowed position;

a second pivot mechanism coupling the worksurface to the arm so that the worksurface can be rotated in a plane relative to the base;

the support including a height adjustment mechanism comprising a rack having a series of teeth, the teeth forming notches between the teeth, and a bar having a projection sized to engage at least one of the notches of the rack, the height adjustment mechanism allowing the worksurface to be presented at (a) a first height relative to the base and (b) a second height relative to the base and (c) a plurality of heights in between the first height and the second height;

wherein the height adjustment mechanism is (a) in a first position to provide the first height and (b) engaged in a second position to provide the second height that is higher than the first height and (c) engaged in a home position between the first position and the second position when the arm is folded to the stowed position; and wherein contact by an edge of the worksurface with a central portion of the base develops a force acting on the height adjustment mechanism such that the projection of the bar moves along a profile of a first tooth of the rack and toward a first notch of the rack into the home position.

13. The article of furniture of claim 12 wherein the teeth on the rack between the home position and the second position have a different profile from that of the first tooth of the rack.

14. The article of claim 12 wherein when the support is folded to the stowed position the bar and the rack are configured to move into engagement in the home position with the projection of the bar engaged adjacent to the first tooth of the rack.

15. The article of furniture of claim 12 further comprising a third pivot mechanism coupling the arm to the support so that the arm can be rotated relative to the support and folded from a generally horizontal orientation in the use position to a generally vertical orientation in alignment with the support for the stowed position.

16. The article of furniture of claim 12 wherein the worksurface has a length and a width when positioned for the stowed position; wherein the base comprises a center portion and two legs; wherein the width of the worksurface is configured to fit within a cavity between the legs of the base in the stowed position.

17. The article of furniture of claim 16 wherein the legs are substantially horizontal when in the use position and the base is generally V-shaped.

18. The article of furniture of claim 16 wherein the legs and the center portion are integrally formed and the base is generally U-shaped.

19. The article of furniture of claim 12 wherein the profile of the first tooth of the rack comprises an angular profile.

20. A transportable table configured to be deployed to a use position and to be folded into a stowed position comprising:

a base comprising a center portion and two legs extending from the center portion;

a support coupled to the base;

an arm coupled to the support;

a worksurface coupled to the arm and comprising a length and a width;

the support having a height adjustment mechanism so that the worksurface can be retained at (a) a fully-lowered first height relative to the base and (b) a fully-raised second height relative to the base and (c) a plurality of heights in between the first height and the second height;

the height adjustment mechanism including a rack having a series of teeth forming a series of notches and a bar having a projection configured so that the bar and the rack are (a) in a first position with the projection of the bar adjacent to a first tooth of the rack when at the first height and (b) engaged in a second position with the projection of the bar in a notch of the rack when at the second height which is higher than the first height;

wherein when the worksurface and the support are positioned in alignment with the base in the stowed position, the width of the worksurface fits within a cavity defined by an inner edge of each of the two legs and the center portion such that the majority of the worksurface is substantially coplanar with a plane defined by the cavity.

21. The table of claim 20 further comprising a worksurface pivot mechanism coupling the worksurface to the arm so that the worksurface can be rotated relative to the base.

22. The table of claim 20 wherein the bar comprises a plurality of projections that are configured to engage a corresponding plurality of notches on the rack when the worksurface is at the second height.

23. The table of claim 20 wherein the first tooth of the rack is positioned adjacent to the first notch and has an angled profile.

24. The table of claim 23 wherein contact by the worksurface at the base when the support is folded to the stowed position develops a force to drive the bar relative to the rack so that the projection travels along and over the first tooth into the first notch of the rack corresponding to a home position, the home position occurring between the first position and the second position.

25. The table of claim 24 wherein the teeth on the rack between the home position and the second position have a different profile from that of the first tooth of the rack.

26. The table of claim 20 further comprising an arm pivot mechanism coupling the arm to the support.

27. The table of claim 20 further comprising a handle adjacent to the support.

28. The table of claim 20 further comprising a projection to facilitate storage.

29. The table of claim 20 wherein the length of the worksurface is greater than the width of the worksurface.

30. The table of claim 27 wherein the handle is positioned adjacent the support such that it is accessible both in the use position and the stowed position.

31. The table of claim 27 wherein the handle is closer to the legs of the base in the stowed position than in the use position.

* * * * *